United States Patent [19]

Ciemiega

[11] Patent Number: 4,695,049

[45] Date of Patent: Sep. 22, 1987

[54] EXERCISE DEVICE

[76] Inventor: Jan A. Ciemiega, 1817 Beloit St., Apt. 10, Los Angeles, Calif. 90065

[21] Appl. No.: 906,142

[22] Filed: Sep. 11, 1986

[51] Int. Cl.[4] ..... A63B 5/00

[52] U.S. Cl. ..... 272/67; 272/131; 272/141

[58] Field of Search ..... 272/140, 141, 137, 131, 272/67, 68

[56] References Cited

U.S. PATENT DOCUMENTS

| | | | |
|---|---|---|---|
| 3,132,861 | 5/1964 | Horney | 272/68 |
| 3,184,234 | 5/1965 | Struble | 272/131 X |
| 3,211,453 | 10/1965 | Williams | 272/131 X |
| 3,396,967 | 8/1968 | Brown | 272/141 X |
| 4,095,789 | 6/1978 | Mueller | 272/67 X |
| 4,634,114 | 1/1987 | Garcia | 272/141 X |
| 4,643,417 | 2/1987 | Nieman | 272/67 |

*Primary Examiner*—Carl D. Friedman

*Attorney, Agent, or Firm*—Allan M. Shapiro

[57] ABSTRACT

First and second handles are rotatable about a common axis. A threaded shaft is secured to the first handle and a pair of nuts is engaged on the threaded shaft and rotate with the second handle. A compression spring between the nuts causes friction at the thread interface. To adjust friction, the handles are separated and then the nuts are rotated with respect to each other to adjust the spring compression.

20 Claims, 6 Drawing Figures

10
12
14
16
18
20
22
24
26
28
30
32
34
36
38
40
42
46
52
56
58
3
3

24
32
46
54
52
48
50
38
40
28
42
44
26
34

EXERCISE DEVICE

BACKGROUND OF THE INVENTION

This invention is directed to a hand, wrist, and forearm exercise device wherein first and second manually graspable handles are rotatable on a common axis with adjustable friction therebetween so as to exercise the hand, wrist, and forearm joints and muscles.

Quite a number of sports activities require strong wrist and forearm muscles. Since sports activities are often not performed sufficiently often to adequately develop these muscles for their occasional sporting use, proper exercise can develop the wrist and forearm muscles so that they are available for that occasional sporting use. Sports activities that require such strength usually employ hand-held sporting implements such as clubs, rackets, or bats. Other sporting activities include horseshoes and skiing. Properly exercised and developed wrist and forearm muscles add to swing power and control. Additional benefits from proper exercise are also realized in throwing activities associated with various types of ballgames, bowling, javelin, and shotput. Other manual activities also are more easily accomplished by the muscular strength produced by proper wrist and forearm exercise.

There are quite a few different sizes, shapes, and styles of wrist and forearm exercisers. It is the amount of torque required to turn one handle with respect to the other that is the measure of the strength required in employing the exerciser. In the prior hand-held exercisers, the torque was difficult to set and often decreased due to wear as the exerciser was used. Thus, it is desirable to provide such an exerciser in which the torque can easily and accurately be set and is substantially constant during use.

SUMMARY OF THE INVENTION

In order to aid in the understanding of this invention, it can be stated in essentially summary form that it is directed to an exercise device which has first and second coaxial manually graspable handles. A screw is secured to one of the handles and a pair of nuts engaged on the screw is rotated by the other handle. A spring between the nuts provides force against the nuts to provide resistance to turning between the handles. A spring adjustment provides adjustment for the amount of torque required to turn the handles with respect to each other.

It is, thus, an object and advantage of this invention to provide an exercise device wherein first and second manually graspable handles can be rotated with respect to each other with a preset torque so that the exercise device can be employed for exercising the hand, wrist, and forearm muscles.

It is another object and advantage of this invention to provide an exercise device wherein an adjustment can be made to adjust the forces on cooperating friction surfaces so that the rotational torque between the first and second handles can easily be selected.

It is a further object and advantage of this invention to provide an exercise device with handles for grasp in the hands wherein the amount of turning of the handles is signaled by indicia which are related to handle position.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENT

Figures 1, 2, 3:
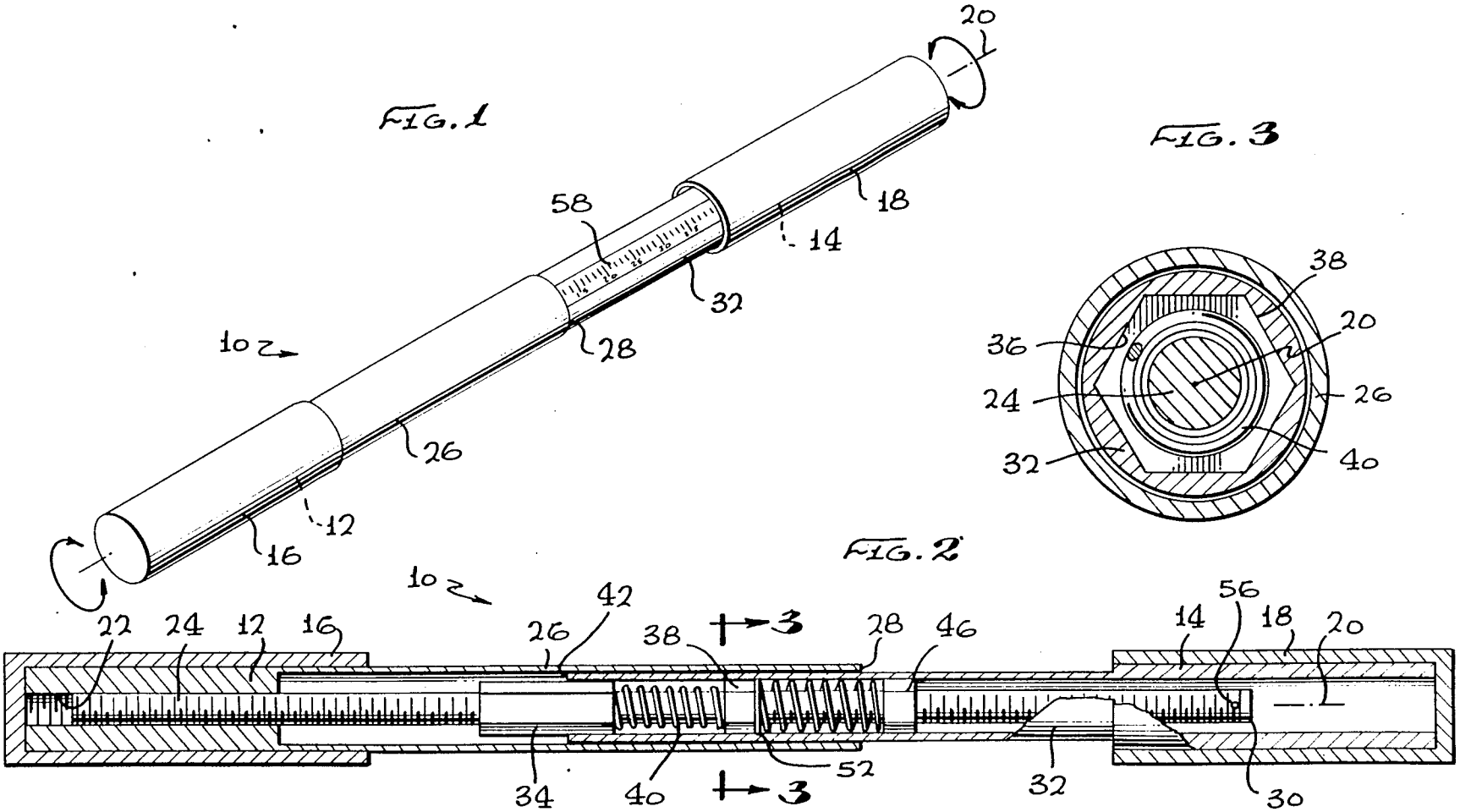
FIG. 1 is an isometric view of the exercise device of this invention.
FIG. 2 is an enlarged side-elevational view thereof, with parts broken away, to mostly show the centerline section therethrough.
FIG. 3 is an enlarged section taken generally along the line 3—3 of FIG. 2.

The exercise device of this invention is generally indicated at 10 in FIGS. 1 and 2. It comprises first and second handles 12 and 14 on which are positioned hand grips 16 and 18. The hand grips are generally cylindrical on the exterior surface and are sized to be conveniently and comfortably grasped in the adult hand. Hand grips 16 and 18 are rotated around their axis 20 with respect to each other to provide exercise. They are maintained in coaxial position, and the rotative resistance is established by the connecting structure between the handles.

Threaded bore 22 receives one end of threaded rod 24. The threaded rod is secured therein by means of adhesive, set screw, or dowel pin. Shell 26 is formed as part of the first handle 12 and extends out from hand grip 16 to terminate in end 28. Threaded rod 24 extends past end 28 to terminate at end 30, which is within handle 14. Tube 32 is formed as part of hand grip 18 and extends to the left and telescopes within shell 26, as seen in FIG. 2. Shell 26 is in the form of a circular cylinder about axis 20 on both its interior and exterior surface. Tube 32 has its exterior surface formed as a circular cylinder about the axis 20 and is sufficiently small to freely enter shell 26. The interior surface of tube 32 is hexagonal is shape, as is described in more detail hereafter.

Nut 34 has interior threads which engage upon the exterior threads on threaded rod 24. The exterior of nut 34 is hexagonal, of suitable distance between faces to enter within the hexagonal opening 36, see FIG. 3, in tube 32. Nut 34 is a first nut, and there is also a second nut 38 also threadedly engaged on threaded rod 24. Nut 38 is positioned to the right of nut 34, as seen in FIG. 2. Nut 38 is seen in end elevation in FIG. 3. Nut 38 also has a hexagonal outer surface, as seen in FIG. 3, and engages within the hexagonal opening 36 of tube 32. Compression spring 40 is engaged between first and second nuts 34 and 38. It is seen that, when handle 12 is rotated with respect to handle 14 (by grasp on their respective hand grips) about the axis 20, the nuts rotate on the threaded shaft. Compression spring 40 urges stress against the nuts to urge them in a separating direction. This stress is applied to the threads and appears as tension in the threaded rod 24 between the nuts. The compression spring 40 thus provides axial force which is transmitted across the interengaging thread faces. Rotation of one of the handles with respect to the other causes relative motion at the thread faces and, with the axial force applied thereto, causes friction which resists the turning of the handles relative to each other. An exercise device is thus created.

Figures 4, 5, 6:
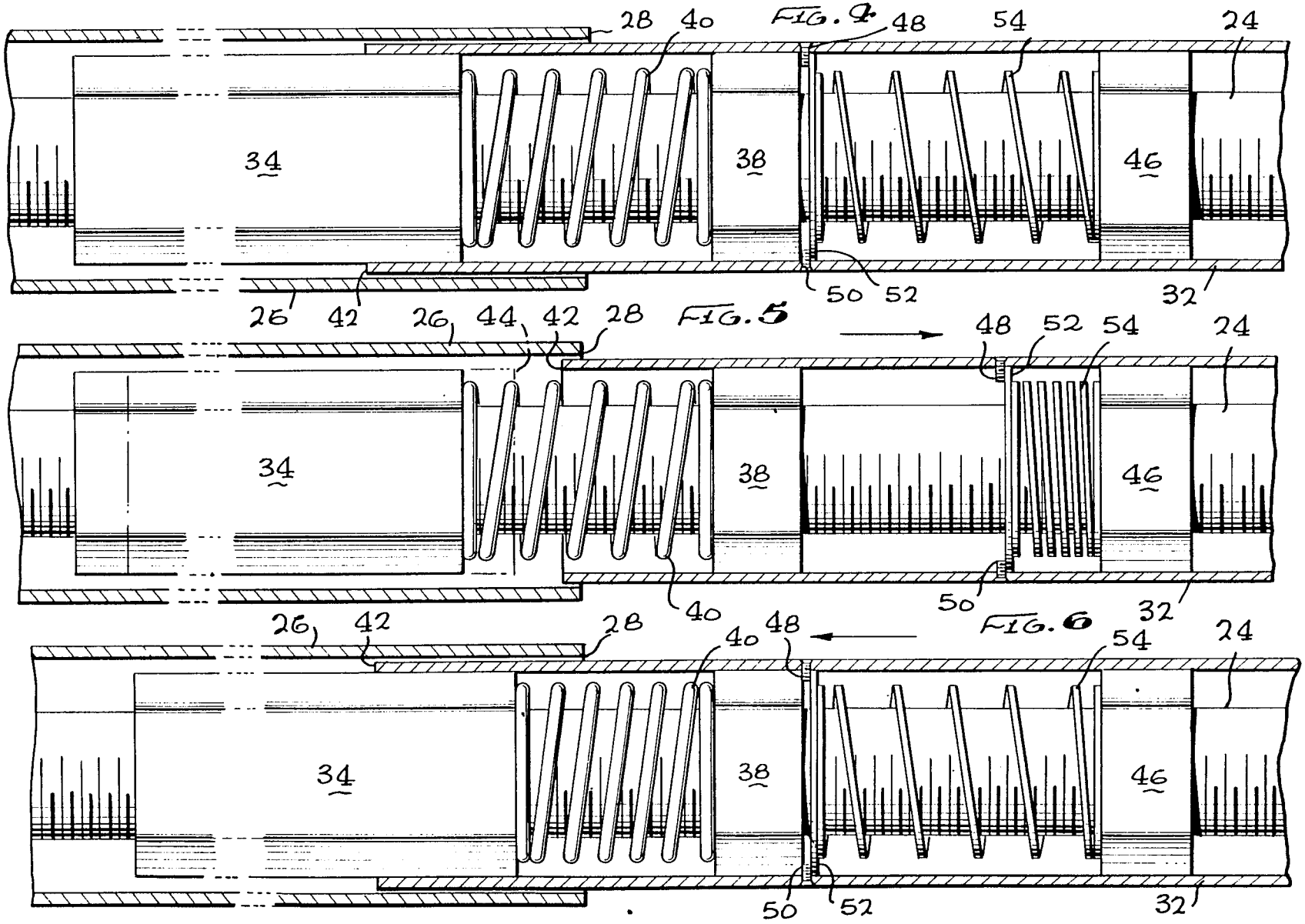
FIG. 4 is a further enlarged side-elevational view, with parts broken away, and showing the exercise device in a first, use position.
FIG. 5 is a similar to FIG. 4 showing the exercise device in an adjustment position.
FIG. 6 is similar to FIG. 4 showing the exercise device in a use position, but after the adjustment of FIG. 5.

It is desirable to be able to adjust the force exerted by compression spring 40. Adjustment of that force would adjust the amount of torque required to rotate the handles with respect to each other. To obtain adjustment, the handle 14 and its tube can be moved to the right to slide the tube 32 with respect to the nuts until the left end 42 is clear of first nut 34. FIG. 4 shows the exercise device in the first operative position, and FIG. 5 shows the tube 32 moved to the right until its left end 42 is clear of nut 44. In this condition, rotation of the right handle 14 with respect to the left handle 12 rotates nut 38 on the threaded rod 24, but does not rotate the first nut 34 on the threaded rod. This results in changing the distance between the nuts 34 and 38 to change the force applied by the compression spring and thus change the amount of rotational friction produced when both nuts are rotated on the shaft. In FIG. 5, the nuts 34 and 38 are shown as being moved closer to each other, to the dotted line position 44 for nut 34. When adjustment is complete, the tube 32 is slid to the left to again embrace both nuts 34 and 36. As seen in FIG. 6, compression spring 40 is compressed to a shorter length so that it now produces more axial force between the nuts to produce more rotative friction.

In order to keep the exercise device 10 together in one piece and to hold the handles in relative axial position during use, third nut 46 is threadedly engaged on the threaded rod and has its hexagonal outer surface engaged within the hexagonal opening 36 within tube 32. Pins 48 and 50 are engaged through the side wall of tube 32 and act as a stop for washer 52. The pins 48 and 50 are shown as set screws, but they can be rivets or any other internal projection into the interior of the tube. Pins 48 and 50 also act as a leftward stop for the tube 32 when they engage against the right side of nut 38, as seen in FIGS. 4 and 6. Compression spring 54 is engaged between washer 52 and third nut 46 to urge the tube 32 to the left until the pins engage against second nut 38. Spring 54 thus acts to hold the tube 32 in the leftmost position, shown in FIGS. 4 and 6, to maintain engagement of the tube on the first nut 34. However, compression spring 54 is relatively light so that fairly low tension force applied between the handles can move the tube 32 to the right to disengage its left end from nut 34. While nut 46 also turns on the threaded rod when the handles are rotated with respect to each other, spring 54 is sufficiently light that it does not contribute substantial frictional torque. What small frictional torque resistance it does apply is constant. Once the compression of spring 40, and thus the frictional rotative resistance in the handles is set, the user can hold one hand grip and handle in each hand and oppositely relatively rotate the handles around the axis 20. If the user continues to rotate the handles 16 in the counterclockwise direction, as seen from the left end of FIG. 1, with respect to the handle 14, there is a chance that he could unscrew the threaded rod from the nuts. In order to prevent this, the threaded rod 24 is provided with a cross pin 56 adjacent its right end 30 in order to act as a limit stop to turning in that direction. Other stop structures could alternatively be used.

It is thus noted that the handles move towards and away from each other, due to the moving of the nuts on the screw thread, in accordance with the relative rotation of the handles. The exercise device 10 is thus provided with a scale 58 inscribed along the outer surface of tube 32. It may have marks corresponding to thread pitch of rod 24 so that each turn can be indicated, as shown on scale 58. The right end 28 serves as the reference line by which the scale 58 is read. Thus, if the exercise regimen calls for a certain number of turns, the user can observe the count on the scale 58 at the beginning and rotate the handles relatively to each other in the same direction until the goal number is reached. Since rotation in the two opposite relative rotational directions creates different exercise for the two hands, wrists, and forearms, an exercise regimen would appropriately call for a certain number of turns in the first direction, followed by the same number of turns in the opposite direction to return the exercise device to the original position. The exercise device 10 thus provides a structure which provides relatively constant torque resistance over a large number of relative turns because wear is minimal due to the large frictional area over which the energy is dissipated. Thus, the exercise device 10 is of long life with uniform rotational resistance. It has convenient adjustment and a direct reading scale which indicates the number of turns the user has accomplished.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An exercise device comprising:

first and second handles sized and shaped for manual grasp;

a threaded rod secured to said first handle;

first and second nuts threadedly engaged with said threaded rod and rotatably secured to said second handle; and a spring engaged with both said first and second nuts so as to produce force on said first and second nuts in a direction along said threaded rod in order to produce rotative friction on said nut with respect to said threaded rod so that when said handles are manually grasped and rotated with respect to each other, said nuts rotate on said threaded rod and the friction therebetween provides resistance to relative rotation of said first and second handles.

2. The exercise device of claim 1 wherein said spring is an adjustable spring so that the force between said nuts can be adjusted so as to adjust the amount of relative rotational friction between said first and second handles.

3. The exercise device of claim 2 wherein said spring is a compression spring.

4. The exercise device of claim 1 wherein said spring is a compression spring.

5. The exercise device of claim 1 wherein said first and second nuts have a non-round outer surface and said second handle has a non-round inner surface which engages with said nut so that when said second handle engages with said nuts, said nuts are irrotatable with respect to said second handle.

6. The exercise device of claim 5 wherein said second handle is in a first position with respect to said first handle when said second handle is in engaged with the non-round surfaces of both said first and second nut and said threaded rod defines an axis through said exercise device, said second handle being movable to a second position away from said first handle when said second handle is disengaged from said first nut so that relative rotation of said second handle when it is in its second position relatively rotates said first the second nuts to adjust said spring interengaging said first and second nuts to adjust the frictional rotation force of said nuts on said threaded rod.

7. The exercise device of claim 6 wherein said spring is a compression spring.

8. The exercise device of claim 7 wherein there is a second spring interengaged between said threaded rod and said second handle to urge said second handle towards said first position.

9. The exercise device of claim 8 further including a third nut threadedly engaged on said threaded rod and said second spring is engaged between said third nut and said second handle.

10. The exercise device of claim 9 wherein there is a stop extending into the interior of said second handle, said stop engaging against said second nut when said second handle is in its first position, said second spring engaging with said stop.

11. The exercise device of claim 10 wherein said stop comprises first and second pins extending into said second handle and there is a washer lying against said first and second pins, said second spring engaging against washer and against said third nut.

12. An exercise device comprising:

a threaded rod defining an axis;

a first handle secured to said threaded rod;

first and second nuts threadedly engaged on said threaded rod, said nuts each having a non-round surface;

a spring engaged with both said first and second nuts to urge said first and second nuts axially with respect to each other to provide thread interface forces between said nuts and said threaded rod;

said first handle being tubular and terminating at an end so that said tubular first handle embraces at least a portion of said first nut;

a tubular second handle which telescopically engages with said tubular first handle, said second handle having a first position wherein said second handle engages with said non-round surfaces of said first and second nuts so that rotation of said first handle with respect to said second handle causes frictional turning of said first and second nuts on said threaded rod.

13. The exercise device of claim 12 wherein said spring is an adjustable compression spring.

14. The exercise device of claim 13 wherein there is indicia on said second handle positioned with respect to said end of said first handle so that the relative axial position of said first and second handles can be determined to determine the number of turns said second handle is turned with respect to said first handle.

15. The exercise device of claim 12 wherein there is indicia on said second handle positioned with respect to said end of said first handle so that the relative axial position of said first and second handles can be determined to determine the number of turns said second handle is turned with respect to said first handle.

16. The exercise device of claim 12 wherein said second handle is axially movable away from said first handle to a position wherein said second handle is disengaged from said first nut and is engaged with said second nut so that relative rotation of said first and second handles causes relative turning of said first and second nut to change the stress of said spring engaged between said first and second nuts to change the rotational friction between said first and second handles.

17. The exercise device of claim 16 further including a third nut threadedly engaged on said threaded rod and there is a second spring interengaged between said second handle and said third nut to urge said second handle towards its first position.

18. The exercise device of claim 17 wherein there is an inwardly directed stop within said second handle, said stop engaging against said second nut when said second handle is in its first position, said second spring engaging between said stop and said third nut to urge said second handle towards its first position.

19. The exercise device of claim 18 wherein there is indicia on said second handle positioned with respect to said end of said first handle so that the relative axial position of said first and second handles can be determined to determine the number of turns said second handle is turned with respect to said first handle.

20. The exercise device of claim 12 wherein said first and second nuts have a hexagonal exterior surface and said second handle has a hexagonal inner surface so that said second handle can slidingly and non-rotatably engage with said first and second nuts.

* * * * *